United States Patent [19]

Sasnett, Jr.

[11] Patent Number: 4,461,401

[45] Date of Patent: Jul. 24, 1984

[54] LIQUID DISPENSER ASSEMBLY

[76] Inventor: Bolling H. Sasnett, Jr., 80 Forrest Lake Dr., NW., Atlanta, Ga. 30327

[21] Appl. No.: 285,147

[22] Filed: Jul. 20, 1981

[51] Int. Cl.[3] ..... B67D 5/22

[52] U.S. Cl. ..... 222/27; 222/130; 377/21; 340/718

[58] Field of Search ..... 222/23, 25–28, 222/36–37, 129–130, 173, 2; 377/21; 211/41; 312/35, 86, 320; 340/700, 718, 756, 811; 194/1 N, 2, 3, 5, 13

[56] References Cited

U.S. PATENT DOCUMENTS

| | | | |
|---|---|---|---|
| 2,631,754 | 3/1953 | Wolfe | 222/173 X |
| 2,927,716 | 3/1960 | Ainsworth | 222/28 |
| 2,996,221 | 8/1961 | Grise | 222/26 |
| 3,190,504 | 6/1965 | Laver | 222/43 X |
| 3,357,531 | 12/1967 | Romanowski | 194/13 X |
| 3,872,282 | 3/1975 | Long | 222/2 X |
| 3,894,658 | 7/1975 | Buell, Jr. | 222/26 |
| 4,131,215 | 12/1978 | Hansel | 222/26 |
| 4,290,538 | 9/1981 | White et al. | 222/25 |

*Primary Examiner*—Joseph J. Rolla
*Assistant Examiner*—Kevin P. Shaver
*Attorney, Agent, or Firm*—Newton, Hopkins & Ormsby

[57] ABSTRACT

An upright tubular housing is divided into a lower compartment, a central compartment and an upper compartment by horizontal partition plates. Within the lower compartment are the hydraulic components which may be any number of a variety of hydraulic systems from conventional non-electronic or electronic gasoline pumps. A meter of the hydraulic system drives a shaft which, in turn, drives a pulser disposed in the intermediate compartment to provide a clock pulse. Within the upper compartment are the electronic components which include the power supply and a number of pc boards or cards, including a computer board carrying a microprocessing unit, a power fail detector, and a non-volatile memory. Information is transfered to the non-volatile memory on shut down or power failure. A battery pack supplies sufficient power for operation of the displays, after shut down. Other boards include a price control board, and an interface board. These boards are slideably carried by selectively swing out or fixed modules having interchangeable upright partitions, the modules being disposed in the upper compartment. The pc boards of the display assemblies are also slideably carried by the modules which permit display assemblies to be selectively positioned in any one of a plurality of positions. The displays, themselves are plugged into their respective pc boards for support thereby.

15 Claims, 10 Drawing Figures

LIQUID DISPENSER ASSEMBLY

BACKGROUND OF THE INVENTION

1. Field of the Invention

This invention relates to a liquid dispenser assembly and is more particularly concerned with a computerized gasoline pump housing suitable for converting the hydraulic oomponents of a conventional gasoline pump into an electronic computerized gasoline pump assembly.

2. Description of the Prior Art

In the past, gasoline dispensers have included hydraulic components having a meter which drive a mechanical computer which, in turn, computes the gallons of gasoline which have been delivered and totalized the cost of the gasoline so delivered. Thus, each such prior pump has had an output shaft which is rotated by the meter, a given number of revolutions for each gallon of gasoline delivered. In certain of these systems, the meter rotates the shaft four times for each gallon gasoline delivered and in certain other types of pumps, the meter rotates the shaft eight times for each gallon of gasoline delivered.

In the prior art electronic gasoline dispensers, the hydraulic system includes the meter which drives a pulser for providing a clock signal to the microprocessing unit, the microprocessing unit in turn delivering appropriate signals to the volume display, the money display, and the price display. Furthermore, there is a linkage from this microprocessing unit (computer) through an innerface board to a remote controller.

The electronics of the present invention are essentially conventional except that there is provided a power fail detector which, when the power fails or drops below a prescribed amount, causes the computer to transfer all the volatile information, in the memory of the computer, to a non-volatile memory. There is also a normal voltage detection means for causing the computer to transfer the data back into the non-volatile memory.

SUMMARY OF THE INVENTION

Briefly described, the present invention includes a liquid dispenser in the form of a gasoline pump assembly, which includes an upright housing provided with a lower compartment, an intermediate or central compartment and an upper compartment. The lower compartment is formed by upwardly diverging panels which define a downwardly tapering tubular member, the lower end of which is mounted on a pedestal or base and the upper end of which is closed by a connector cover or lower partition plate having a skirt with corner brackets which permit expansion and contraction of the skirt. The skirt overlies the upper end portion of the lower housing section so as to define a closed lower compartment which receives the various hydraulic components of the conventional gasoline pump.

The intermediate compartment is defined by opposed transverse and longitudinal intermediate rectangular panels, which form a rectangular tubular member, the lower end of which is mounted on the upper surface of the connector cover or lower partition plate and the upper end portion of which supports the upper partition plate of the upper housing which defines the upper electronic receiving compartment.

The electronic receiving compartment usually receives four modules, each of which is formed of a plurality of opposed pairs of upright partitions having side surfaces provided with holes and flanges provided with holes. The modules are arranged two to a side and carry the display assemblies as well as the pc board or boards which complete the electronic circuitry. The power supply assembly is also disposed in the upper compartment. Each of the modules can selectively pivot or be mounted firmly in place, as desired.

The windows for the various displays are shielded from the sunlight by material which has horizontal louvres preventing the sun from diminishing appreciably the distinctiveness of the light forming the display.

The electronics of the present structure includes a non-volatile memory which, when the power supply drops below 90 volts, causes the computer to transfer all memory from the volatile memory of the microprocessing unit into the non-volatile memory. A battery pack provides emergency electricity sufficient for the display to be energized so that, upon power failure, the customer's gallons and cost can still be read.

The pulser of the present invention is carried by a support which is adjustable laterally so that gears can be selectively provided for driving the pulser at prescribed rates, depending upon the ratio of the meter.

The structure of the present pump housing is particularly adapted to be assembled at subassembly points so that at various locations, old conventional mechanical pumps may be converted into new electronic dispenser, using the old pump components and using the new electronic circuitry for the various displays.

Accordingly, it is an object of the present invention to provide a fluid dispenser assembly which is inexpensive to manufacture, durable in structure and efficient in operation.

Another object of the present invention is to provide a fluid dispenser assembly which is suitable for being produced utilizing conventional used hydraulic components and will adapt such hydraulic components into an electronic gasoline pump to display the amount of liquid delivered and its price, electronically.

Another object of the present invention is to provide a liquid dispensing assembly which utilizes electronic equipment and which has a housing which facilitates the installation and removal of the electronic equipment.

Another object of the present invention is to provide a liquid dispensing assembly in which the light from the electronic display will not be diminished, appreciably, by sunlight.

Another object of the present invention is to provide a liquid dispensing assembly which will effectively isolate the hydraulic portion of the system from the electronic portion and which is particularly suitable for adaptation to any existing hydraulic system.

Another object of the present invention is to provide a liquid dispensing assembly which has few parts and is particularly suited to be prefabricated and, then readily assembled by semi-skilled labor using few tools.

Another object of the present invention is to provide a liquid dispensing assembly which will insulate the electronic components from heat and cold.

Another object of the present invention is to provide in a liquid dispensing assembly, a housing which can be readily and easily constructed and which will isolate the hydraulic system from the electronic portion of the assembly.

Other objects, features and advantages of the present invention will become apparent from the following description when taken into conjunction with the accompanying drawings, wherein like characters of reference designate corresponding parts throughout the several views.

DESCRIPTION OF THE PREFERRED EMBODIMENTS

Figure 1:
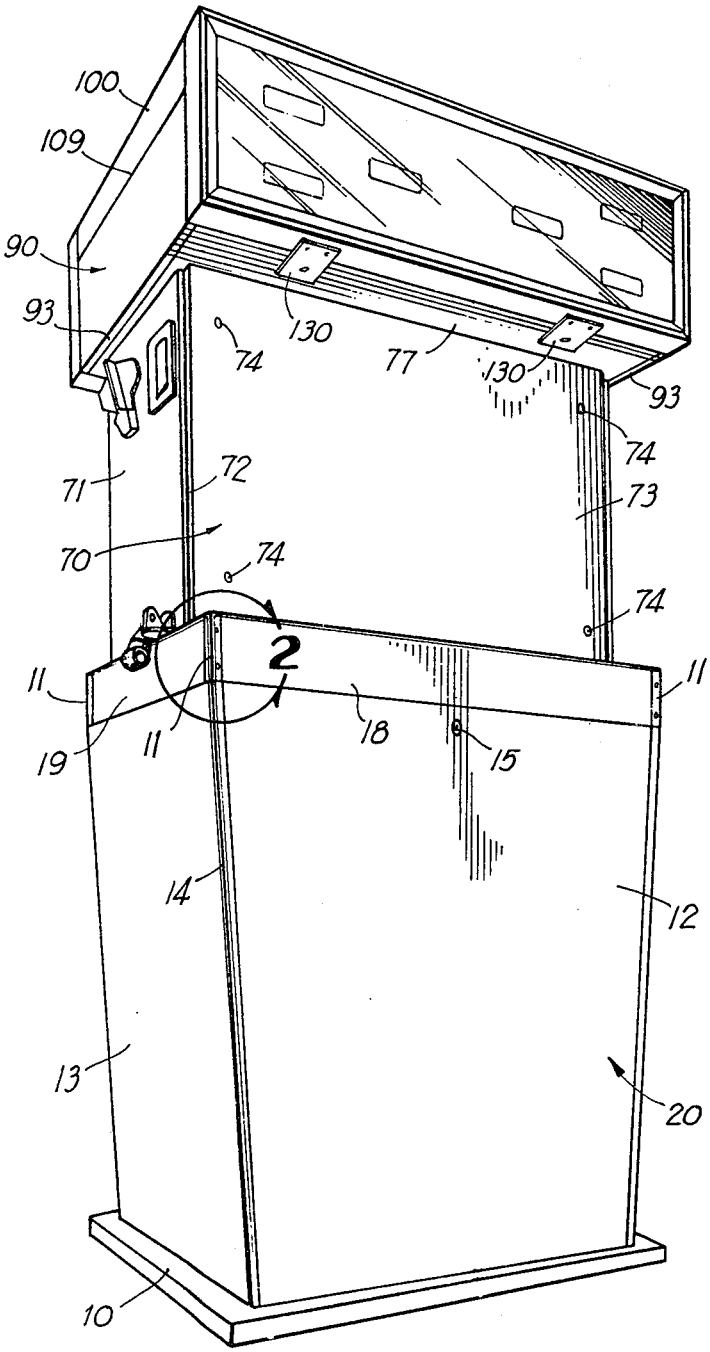
FIG. 1 is a perspective view of a liquid dispensing assembly constructed in accordance with the present invention.

Referring now in detail to the embodiment chosen for the purpose of illustrating the present invention, numeral 10, in FIG. 1, denotes generally the flat rectangular base of the liquid dispensing assembly on which is received the lower housing or hydraulic housing, denoted generally by the numeral 20. In more detail, the hydraulic housing 20 is an upright tubular member formed of downwardly tapering opposed upright front and back panels, such as front panel 12 and downwardly tapering opposed side panels 13. These panels 12 and 13 are thus each trapazoidal in shape so as to diverge upwardly from each other, the side panel, such as side panel 13, having inwardly tapered side flanges 14 against which the flanges of front and back panels, such as panel 12, abut. A conventional lock 15 secures each panel 12 in place.

It will be understood that the liquid dispensing assembly is symetrical on the outside and thus has complimentary front and back side which are essentially identical.

Within the lower compartment formed by the lower housing 20 are the usual hydraulic components (not shown) for two independent pump systems, one on the left hand side and one on the right hand side, which permit the dispensing of gasoline from each side of the assembly. Thus, these hydraulic components may include such elements as the suction pump, P1 in FIG. 10, a motor M1, for driving the suction pump P1, an air eliminator, a meter, valving such as valve V1 and such other hydraulic components as are conventional for each pump system. Suffice it to state that in all such hydraulic (gasoline) systems, a meter drives an output shaft 29 which revolves a prescribed a number of times per gallon delivered. Certain hydraulic systems such as Wayne, Tikhine, Gilbarico, A. 0. Smith and Southwest, have an output shaft 29 which rotates four times for each gallon of gasoline delivered by the pump P1. The Bennett hydraulic system has a meter which revolves eight times for each gallon of gasoline delivered. The end of the shaft 29 of any such system, which is selected to be installed in the housing, is connected to a coupling 16, shown in FIG. 7 and 8. The motor for the pump P1 of the system is designated motor M1 in the logic diagram of FIG. 10 and the valve which releases the liquid (gasoline) designated valve V1.

Figure 2:
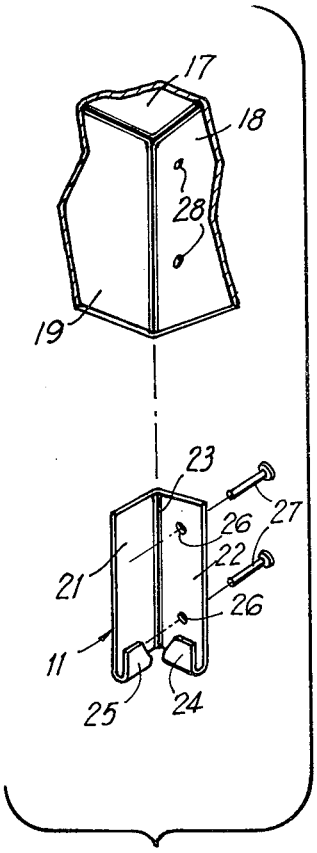
FIG. 2 is an enlarged exploded perspective view of that portion of the liquid dispensing assembly encompassed by the circular line 2 of FIG. 1.

It is thus seen that the housing 20 is an upstanding tubular member, the upper end portion of which is closed by a flat, horizontally disposed, rectangular, connector cover or lower partition plate 17 having downwardly turned flanges, such as flanges 18 and 19, at its edges, the flanges overlying the upper end portions of the panels, such as panels 12 and 13. The abuting edges of the flanges 18 and 19 form corners yieldably secured together by corner brackets 11 which are shown in detail in FIG. 2.

In more detail, each corner bracket 11 is an angle iron and includes a pair of right angularly disposed flanges 21 and 22 which are connected together along a common vertical edge 23. The lower end portion of each of the flanges 21 and 22 are bent inwardly and then back against itself to form retaining hooks 24 and 25. The flange 22 is provided a pair of holes 26 through which rivets 27 project. The rivets 27 are received in holes 28 of the flange 18 while the lower edges of the end portions of each flange 18 and 19 is cradled slideably in the hooks 24 and 25, respectively. By such an arrangement, the bracket 11 is readily secured to each of the end portions of each flange 18 and 19 and permits limited movement of the adjacent ends of flanges 18 and 19 toward and away from each other, the ends of the flanges 18 and 19 riding in their hooks 24 and 25. Thus, the brackets 11 serve a double function of shielding the sharp edges of the flanges 18 and 19 while, at the same time, permitting limited movement of these flanges 18 and 19 so that, with the flanges 18 and 19 flaired out, the plate 17 can be inserted onto the upper end portion of the housing 11. The flanges 21 and 22 are then pressed inwardly and stay in such positions for aligning holes 26 and 28 to receive rivets 27. By such an arrangement, the fumes within the lower chamber defined by the housing 20 will be confined by plate 17 within the lower compartment.

Figure 7:
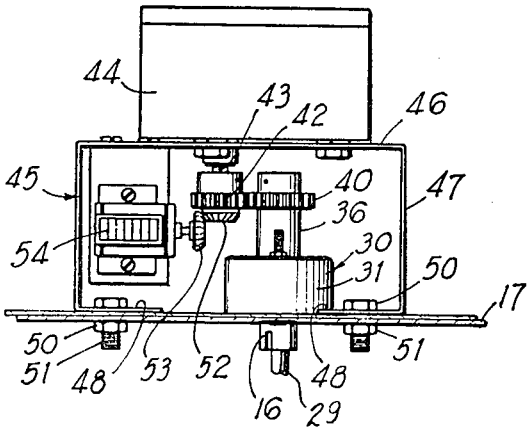
FIG. 7 is an enlarged vertical sectional view of the gear train of the pulser of the liquid dispensing assembly depicted in FIG. 1.
Figure 8:
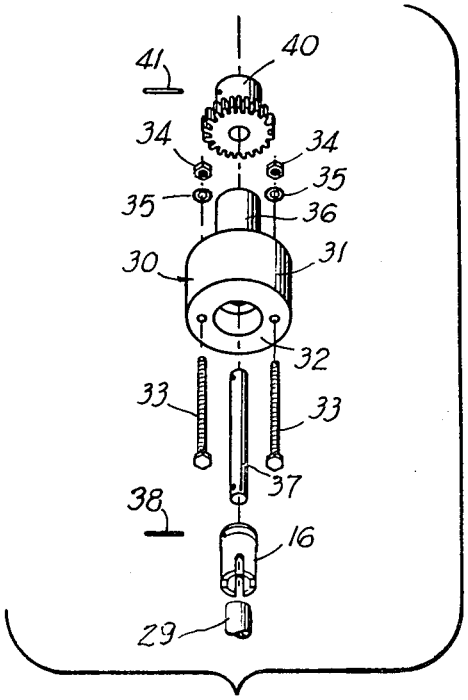
FIG. 8 is an enlarged exploded perspective view of a detail, showing a portion of the structure depicted in FIG. 7.

The plate 17 has three main openings therein, one opening for each pump system and a central opening. Each opening for a pump system is sealed, as depicted in FIGS. 7 and 8, by a vapor bearing 30. In more detail, each gasoline system has vapor bearing 30 includes a housing having a cylindrical base 31, the lower end portion 32 which is flat and rests upon the upper surface of the plate 17, as depicted in FIG. 7, and closes the one opening. Bolts 33, which pass upwardly through the plate 17 and thence through holes on opposite sides of the base 31, receive nuts 34 and washers 35 for securing the base 31 in place over its opening. At the upper end of the base 31 an upstanding sleeve 36 forms the bushing of the vapor bearing 30 for receiving a connector shaft 37. The connector shaft 37 protrudes down through the opening in the plate 17 and its lower end portion is connected to the coupling 16 by means of a shear pin 38. The coupling receives the end of output shaft 29. The upper end portion of connector shaft 37 protrudes outwardly of the bushing 36 and receives an output or drive gear 40. A shear pin 41 connects the drive gear 40 to shaft 37. Shaft 37 and gear 40 rotate about a common vertical axis.

As pointed out above, the various types of meters (not shown) which are currently in the conventional hydraulic equipment, may rotate four or eight times per gallon of gasoline delivered, depending upon the make of the meter. In the event that there is a meter which drives the output shaft 29 which is connected to the coupling 16, only four revolutions per gallon, the output gear should have forty teeth, whereas, if the output shaft 29 rotated eight times for each gallon, then an output gear 40 with only twenty teeth would be necessary. Thus, regardless of which type or pump or hydraulic system is incorporated into the assembly, the same number of teeth, namely 80 teeth, will be moved past a given point as the gear 40 is rotated to indicate a gallon of gasoline delivered. A gear with 80 teeth, however, has a larger diameter than a gear with 40 teeth.

Gear 40 meshes with a driver gear 42 which is mounted for rotation on the downwardly extending input shaft 43 of a transducer, namely a pulser or pulse transmitter 44. Thus, for each gallon, the pulser 44 will provide time space electrical pulses to feed this clock signal to the interface board 60.

A laterally moveable transducer support bracket 45 supports the pulser 44 in a position so that the gear 42 will mesh with the gear 40. This bracket 45 includes an upper rectangular plate 46 and a pair of opposed downwardly protruding legs 47, the end portions of which are turned inwardly to provide slotted feet 48. The feet 48 have inwardly opening slots, through which bolts 50 project, the bolts passing through secondary holes in the plate 17 and being secured in place by nuts 51. When the nuts 51 are loosened, the support bracket 45 can be shifted laterally so as to move the gear 42 into and out of engagement with the gear 40. Thus, regardless of the diameter of the gear 40, and regardless of whether or not it has twenty or forty teeth or any given number of teeth, the shifting of the bracket 45 will permit the appropriate positioning of pulser 44 so that gear 42, which is on the same plane as gear 40, will mesh therewith.

The lower end portion of the gear 40 is provided with a beveled gear 52 which, in turn, meshes with a beveled gear 53 on the end of a mechanical counter 54 supported by a downwardly protruding plate 55 carried by the bracket 45 as illustrated in FIG. 7. The counter 54 functions as a mechanical totalizer to indicate the number of gallons delivered by the pump.

Figure 4:
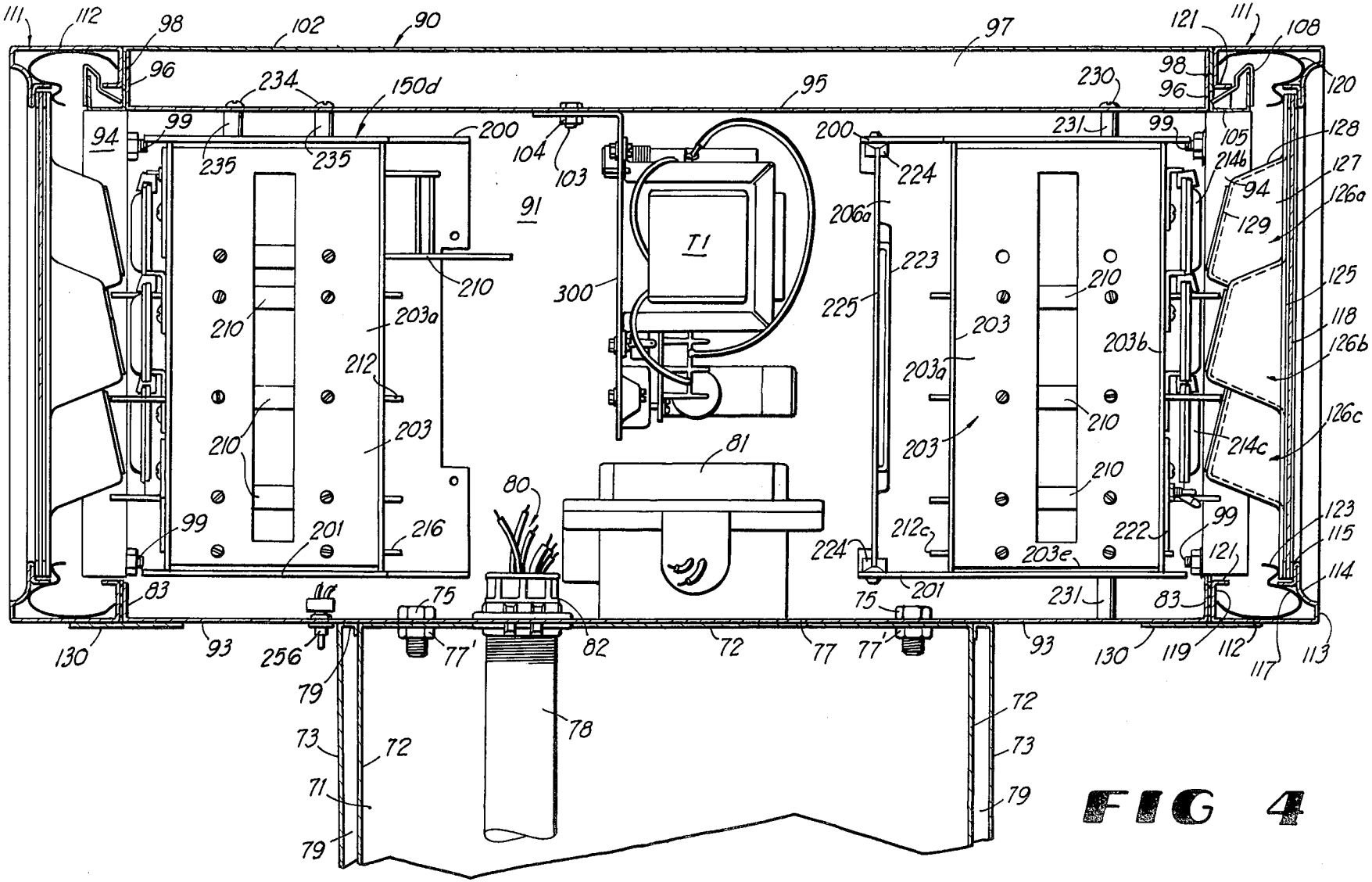
FIG. 4 is an enlarged vertical sectional view of the upper portion of the liquid dispensing assembly depicted in FIG. 1.
Figure 10:
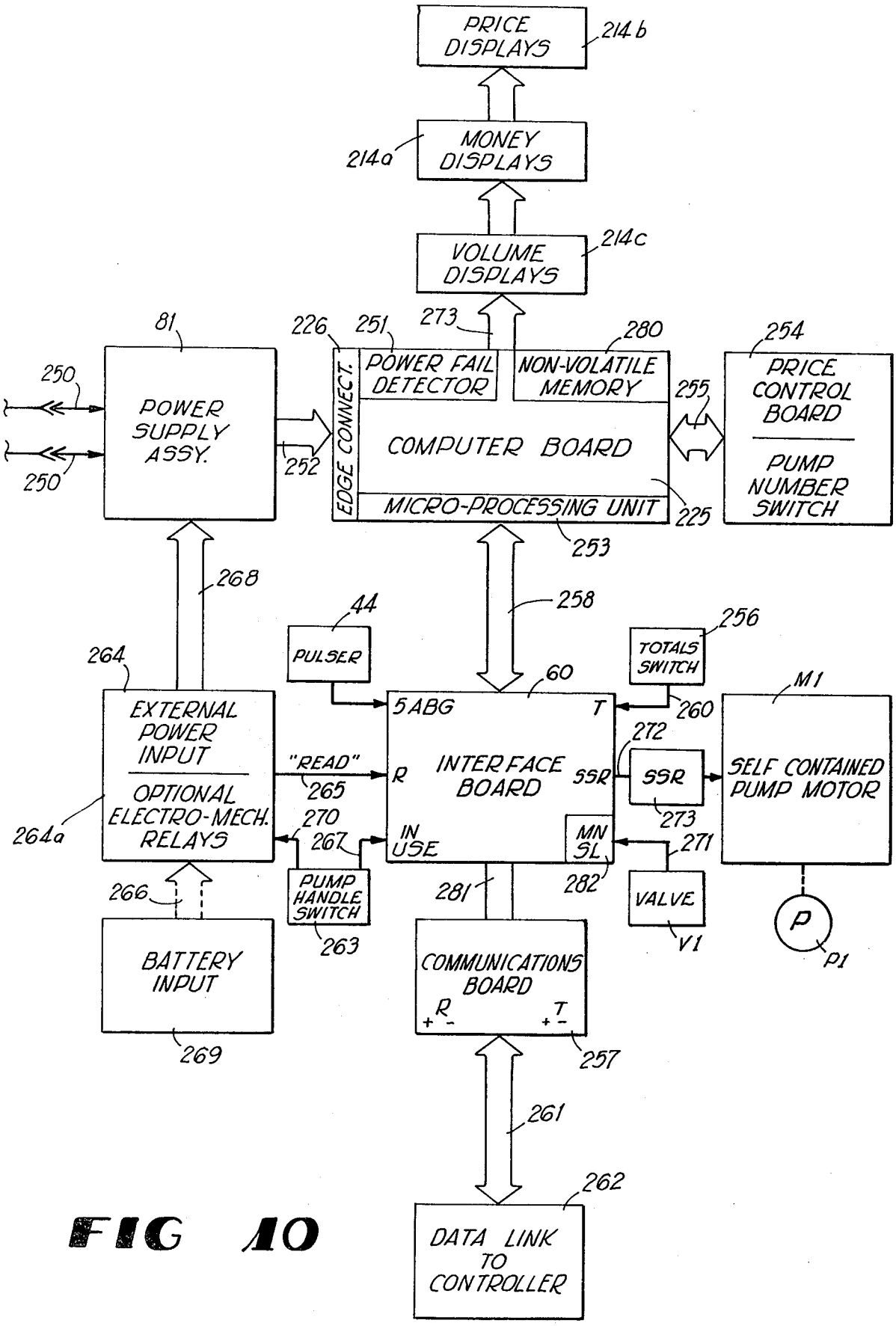
FIG. 10 is logic diagram of the electronics of the liquid dispensing assembly depicted in FIG. 1.

The pulser 44 feeds appropriate electrical pulsers to the interface board 60 shown in FIG. 10. The pulser 44 is usually the sole piece of equipment located in the central or intermediate compartment, defined by a rectangular hollow tubular intermediate housing 70. This intermediate housing 70 is formed by opposed pairs of end panels 71 which have inwardly turned flanges forming a flange perimeter 72. Opposed front and back panels 73 having perimetal flanges 79 are appropriately secured to the end panels 71, as illustrated in FIG. 4 and these panels 73 form flat surfaces for appropriate ads to be disposed thereon. Screws 74, seen in FIG. 1, secure the panel 73 in place against flanges 72.

Bolts 75, seen in FIG. 4, which pass down through a rectangular upper partition plate 77, bolt the central portion of plate 77 in place on the upper surface of the perimetal flanges 72. Nuts 76 secure the bolts 75 in place. Similar bolts secure the bottom portion of perimetal flanges 72 to the upper surface of plate 17.

The central or intermediate compartment formed by the central housing 70 is provided with a vertical central conduit pipe 78, through which wires 80 extend so as to provide appropriate power for the power supply assembly 81, and power therefrom to the motor M1 and valve V1, depicted in FIG. 10. The conduit 78 protrudes through the plates 17 and 77 and is secured by appropriate couplings such as coupling 82. Electrical cables from the pulser 44 of both systems pass through the conduits such as conduit 78 and, thence, up into the upper compartment, as portions of the cables 80.

The rectangular partition plate 77 is disposed horizontally and forms the base of the upper housing 90 which encloses the upper compartment. The base 77 is of larger dimensions than the dimensions of the intermediate housing 70 and therefor protrudes, as seen in FIG. 1, outwardly of the panels 71 and 73. The side ends of the plate 77 are turned upwardly to provide upstanding front abutment flanges 83 in opposed relationship to each other.

Figure 3:
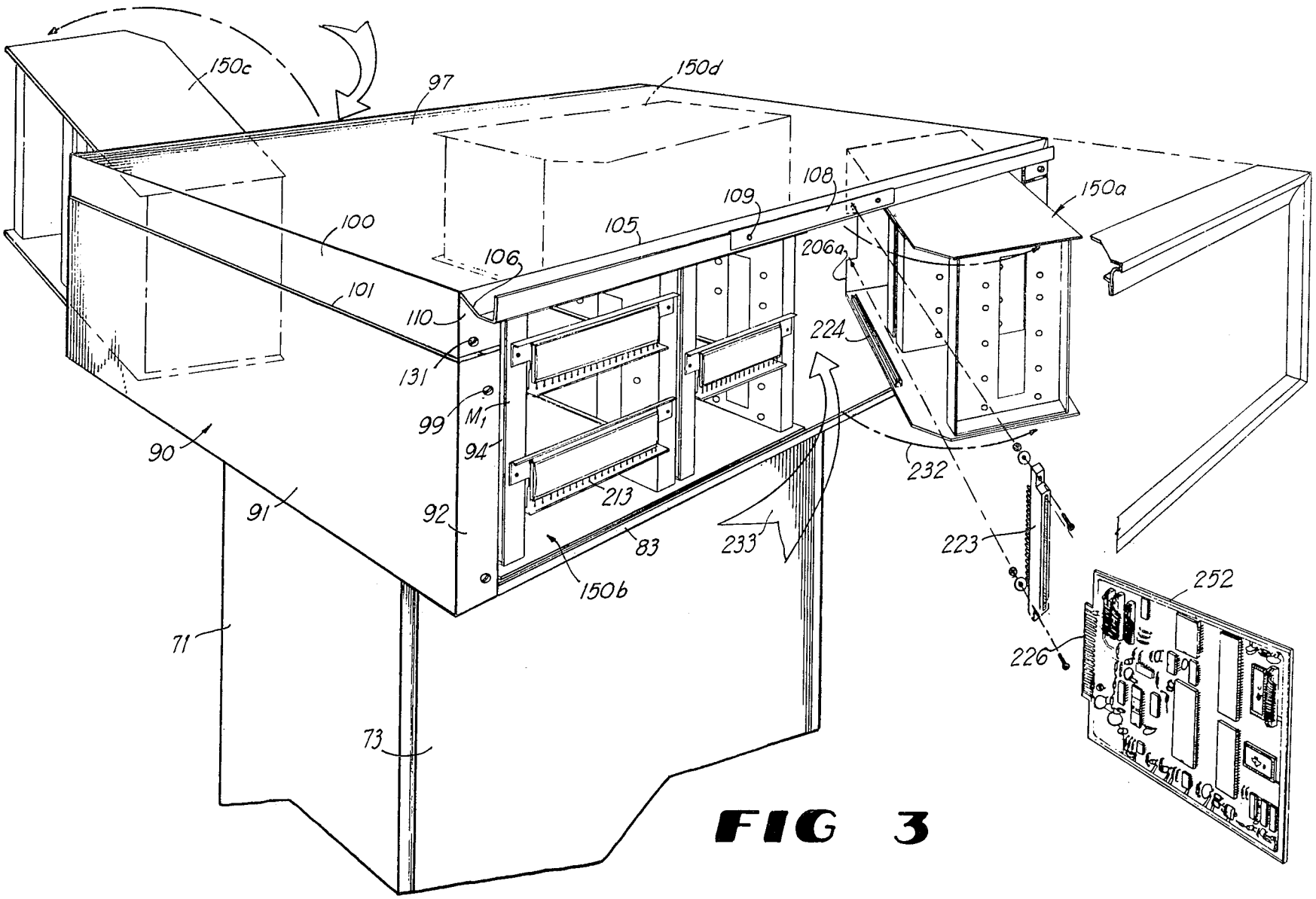
FIG. 3 is an enlarged fragmentary exploded perspective view of the upper portion of the liquid dispensing system depicted in FIG. 1, portions of which have been deleted for clarity.

At the side ends of the plate 77, there are provided upstanding, opposed, parallel, side panels 91 which are spaced outwardly of the side panels 71. Each of the side panels 91 is turned inwardly to provide front and back flanges 92, in common parallel planes. These front flanges 92, as seen in FIG. 3, overlie portions of the front flange 83. The bottom portion of each panel 91 is turned inwardly to provide a bottom flange 93, shown in FIG. 3, the bottom flange being welded or riveted to the lowest surface of the plate 77. The flanges 92 are secured to L-shaped uprights 94 by means of bolts 99, seen in FIG. 3.

Parallel to and above horizontal partition plate 77 is a rectangular top plate 95, the edges of which are turned upwardly to provide front and back flanges 96 and side flanges 97 which form an upper perimetal edge.

A top outer plate or cover 102 is disposed over the upper plate 95 and has downwardly extending front and back flanges 98 and side flanges 100 which overlie the upstanding flanges 96. These front and back flanges 98 are secured to the flanges 96 by riveting, bolting or the like. Thus, there is provided an upper electronic receiving compartment having a top dead air space between plates 95 and 102 to insulate the top of the housing 90.

The lower end of side flanges 100 are offset outwardly as indicated at numeral 101 to provide the shoulders received on the upper edge of panels 91. Tabs 110 on side edges of flanges 101 overlie the inner flanges of the upright 94 and are bolted thereto by bolts 131.

Suspended from the central portion of the upper plate 95 is a central L shaped bracket 300 secured in place thereto by a bolt 103 and its nut 104. This bracket 300 supports a transformer T1 of the power supply assembly 81. It also supports other elements of this conventional power supply assembly which will not be described in detail.

The front and rear edges of the plate 97 are bent downwardly and outwardly and then upwardly so as to provide a water receiving and directing trough, denoted in FIG. 3 by the numeral 105. This trough 105 is thus an upwardly open channel member, the ends 106 of which converge downwardly so as to direct the rain water to the side edges of the upper housing 90. The central front edge portion of the channel member 105 is provided with a U-shaped alignment clip 108 which is riveted by rivets 109 to the front flange of the channel 105.

As seen in FIG. 4, the clip 108 has a vertical front portion which abuts the front portion of the outer flange of the channel member 105 while the inner portion of the clip 108, loops over the upper edge of that flange and extends downwardly and inwardly at an incline, being provided at its central portion with a step 130 which has a vertical abutment shoulder. The function of the clip 108 is to position the top edge of the bezel, denoted generally by the numeral 111, when it is hung on the clip 108, and urge the bezel against the housing 90.

In more detail, the bezel 111, which is received by both the front and back of the housing 90, includes a forwardly protruding, hollow, tubular, rectangular member 112, formed of sheet metal rectangular flanges, two of which are disposed of horizontally in spaced parallel relationship and two of which are disposed vertically in spaced parallel relationship. The forward ends of these plates, which form the tubular member 112, are turned inwardly to form a front perimeter 113 which is disposed vertically, the inner edges of the front perimeter 113 being curved inwardly so as to provide concaved parallel frame members 114, two of which are disposed horizontally and two of which are disposed vertically. The inner edges of the frame members 114 are reversely bent, at numeral 115, to provide inwardly opening angle irons which form the inner frame 117 for receiving and holding the rectangular window frame 118. The window frame 118 has a transparent rectangular window 116 against the inner surface of which a face cover plate 125 fits. A plurality of C-shaped clips or spring elements 120, seen in FIGS. 4 and 5 urge the face plate 125 into the inner frame 117. The rear edge portions of the spring clips 120 abut the inwardly protruding inner flanges 119 on the inner edges of the tubular member 112. The inner edges of the flanges 119 are provided with forwardly protruding shoulders 121, the upper shoulder 121 abutting shoulder 110 of the clip 108. This yieldably limits the downward and outward movement of the bezel 111.

The C-shaped clips 120 are spaced circumferentially around the interior of the bezel 111 and have inwardly protruding fingers 123 which engage the inner surfaces of the cover plate 125 which, in turn, is urged by the fingers 123 against the back surface of the window 118. The face cover plate 125 includes a plurality of recessed windows **126*a*, 126*b*, 126*c*, 126*d*, 126*e* and 126*f* each of which is identical in construction. The windows 126*a* and 126*b* are spaced vertically one over the other, while on one side the windows 126*e* and 126*f* are spaced vertically from each other on the other side, being respectively aligned with the windows 126*a* and 126*b*, horizontally. In addition, the window 126*c* is spaced inwardly of and vertically between the windows 126*a* and 126*b* while the window 126*d* is spaced inwardly of and vertically between the windows 126*e* and 126*f***.

Figure 6:
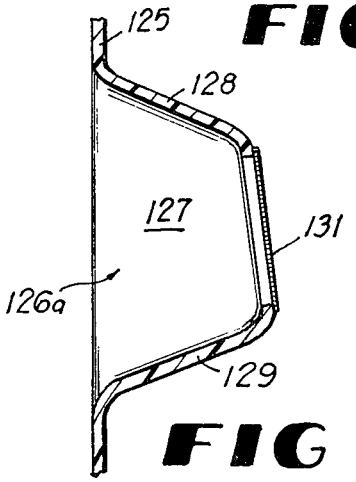
FIG. 6 is a vertical sectional view taken substantially along line 6—6 in FIG. 5.

It will be understood by those skilled in the art that the windows **126*a*, 126*b* and 126*c* are for the operation of one pump system carried by the liquid dispensing assembly while the windows 126*d*, 126*e* and 126*f* are for the other pump system carried by the liquid dispensing assembly. As seen in FIG. 4, the recessed window 126*a* for example includes inwardly and rearwardly converging side walls 127 and inwardly and rearwardly converging upper and lower walls 128 and 129 which terminate in a flat inclined display window receiving surface 129. The window surface 129 is inclined at an obtuse angle of from about 5° to about 20° and preferrably about 10° to the vertical, so as to face downwardly and outwardly. This shades the light from the sun. In a modified form shown in FIG. 6, the open window is provided with a thin transparent rectangular light retarding sheet or film 131 adhered to the window 126*a*. The sheet being a light control film of clear plastic with a plurality of spaced, horizontal, opaque black lines or louvers, which reduce or eliminate sunlight, entering angularly, from passing through the film 131 and into the interior facilitate the distinctiveness of the light displays which are disposed behind the pane 130 or the sheet 131, as the case may be. The sheet 131 is adhered to the back surface of the recessed window 126*a* by means of glue or other adhesive. Film 131** is a product of the Visual Products Division of Minnesota Mining and Manufacturing Co. (3M) of St. Paul, Minn.

By removing the spring clips 120, the face plate 125 and also the window 116 may be readily removed and replaced as desired. The face plate 125 is preferrably made of pressed fiber board material.

Figure 5:
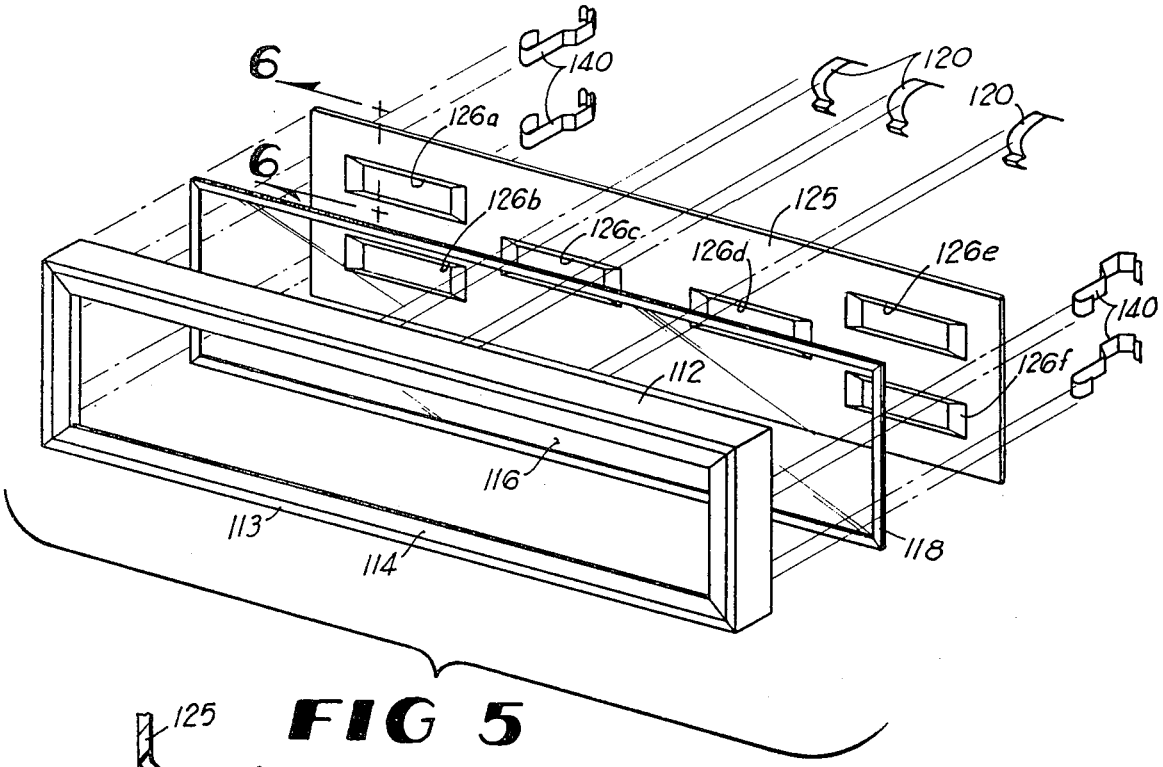
FIG. 5 is an exploded perspective view of the bezel assembly of the upper portion of the liquid dispensing assembly depicted in FIG. 1.

In FIG. 5, it is seen that the bezel 111 is provided with side spring clips 140, these clips being received in the vertical sides of the bezel 111 and have inwardly protruding surfaces which fractionally engage the outwardly protruding flanges of the angle iron uprights 94, whereby the bezel 111 is frictionally centered and the bottom plates 130 will be positioned so as to be riveted in place.

When it is necessary to remove the bezel 111, the screws from the plate 130 are removed and the bezel 111 is swung outwardly and then lifted.

Figure 9:
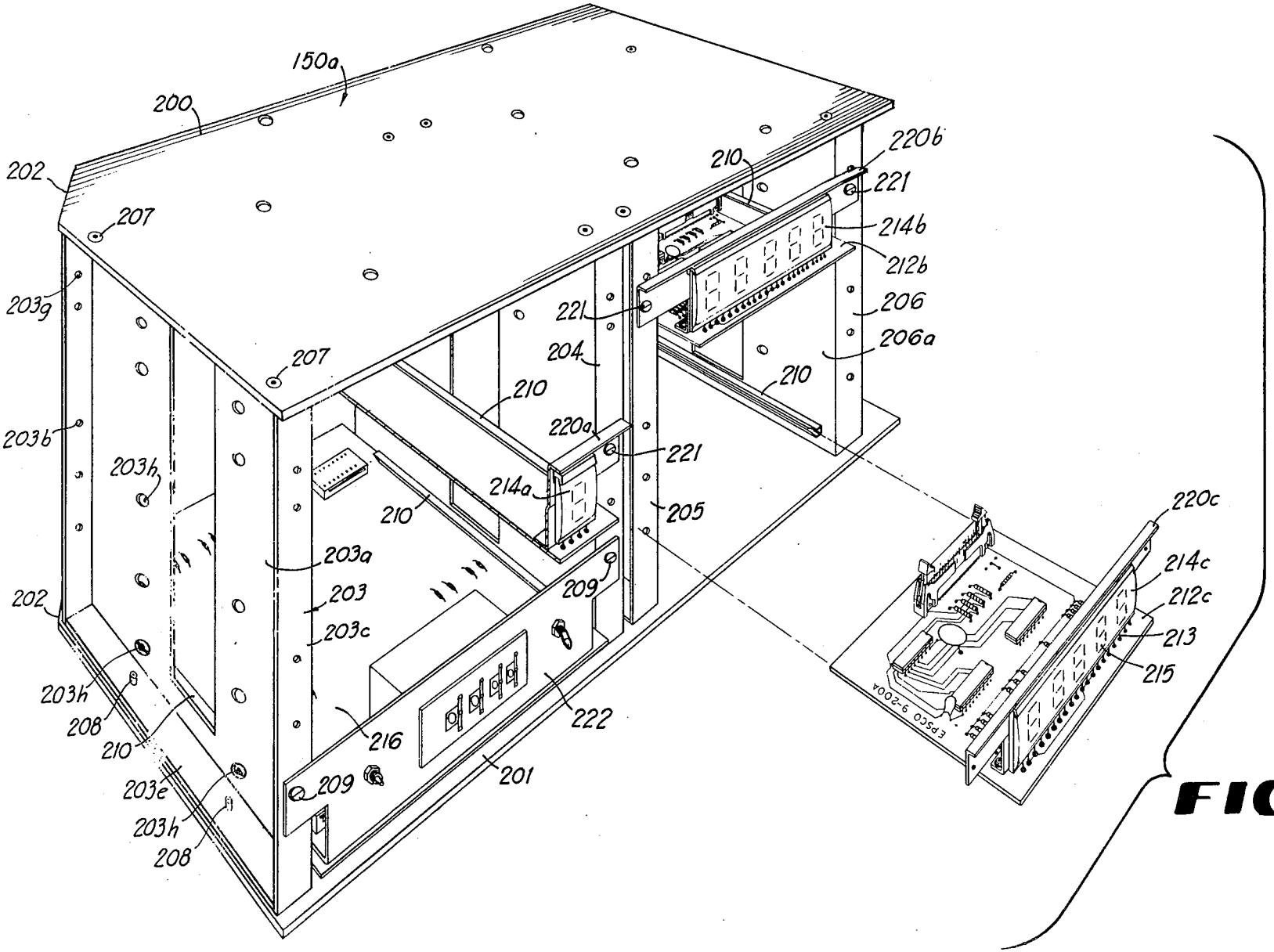
FIG. 9 is an enlarged exploded perspective view of a module utilized in the liquid dispensing assembly depicted in FIG. 1, a portion of the electronic structure therein being deleted for clarity.

Inwardly of the windows **126*a*, 126*b*, 126*c*, 126*d*, 126*e*, the upper compartment is provided with four substantially identical modules, such as the modules 150*a*, 150*b*, 150*c* and 150*d* shown in FIG. 9. Each such module includes spaced, opposed, horizontally disposed top plate 200 and bottom plate 201 which are complimentary, flat, metal, rectangular members, cut off at one corner to provide a diagonal short edge 202. Disposed between these parallel plates 200 and 201 are a plurality of spaced complimentary, parallel, vertically disposed, opposed pairs of upstanding partition walls 203, 204, 205 and 206. The partition walls 203, 204 and 205 are identical in construction, each being a channel member, as illustrated for partition wall 203 and includes a flat rectangular partition member 203*a* having opposed, parallel, vertically disposed, spaced, front and back side flanges 203*b* and 203*c* which are integrally connected to the front and back edges of the partition member 203*a*. In addition, each partition wall is provided with a top and bottom flange, such as bottom flanges 203*d* and along its top and bottom edges so that the partition 203 can be readily connected by pop rivets 207 to the top plate 200 and by pop rivets 208 to the bottom plate 201**.

In the partition 203, the flanges **203*b* and 203*c* are inwardly of the edges of the plates 200 and 201 and are provided with vertically spaced holes 203*f* and 203*g*, through which metal screws, such as screw 209, project in securing the electronic equipment in place. Furthermore, the partition member 203*a* is provided with vertical and horizontal rows of holes 203*h* which receive rivets, such as rivets 203*i* for securing the runners or tracks 210 to the partition member 203. The tracks 210** are U-shaped, channel members which open inwardly and are disposed in opposed pairs, such as track 210 attached to partition 203 and track 210 attached to partition wall 204. Opposed pairs of these tracks 210 slideably receive by their opposed edges rectangular pc board, such as board 212 therein. Indeed, more than one opposed pair of tracks 210 may be provided between the opposed surfaces of the pair of partition members. Generally speaking, the partitions walls, such as partitions walls 203 and 204, are disposed in back to back relationship so that the runners can be secured to the partition members, such as member 203*a*, without being impeded by the outwardly extending flanges, such as flange 203*b* and 203*c*. More than one such opposed pair of tracks 210 can be and usually are provided so as to receive more than one horizontally disposed removeably, printed circuit board or cards 212.

The pc boards 212 are substantially identical in size, eventhough they may contain different IC chips and resistors. Each pc board 212, however, is provided with a row of spaced upstanding pins 213 along its front edge on which are inserted a light emitting diode visual display, designated by the numerals 214*a*, 214*b* and 214*c*. Each display is a rectangular member having a transparent cover and a plurality of light emitting diodes forming display numerals 215.

In the present embodiment, there are three slideable cards or pc boards 212 for each module 150*a*, 150*b*, 150*c* and 150*d*. They respectively have the upstanding displays 214*a*, 214*b* and 214*c*. Each display 214*a*, 214*b* or 214*c* is supported in its upright position by a Z-shaped bracket 220*a*, 220*b* and 220*c*. The foot of each bracket is secured to the pc board behind the upstanding pins 213 and has wings which extend outwardly on opposite sides of its associated pc board so as to be secured by bolts, such as bolt 221, to the flanges, such as flange 203*c*.

One display 214*a* is the money display. Another display 214*b* is the price display while the third display 214*c* is the volume display.

In addition, there are control pc boards, such as board 216 and its upstanding flat metal front panel 222 which can be removeably received by the runners 210. In such instances, the front plate, such as plate 222, is bolted to the flanges, such as flange 203*c*, by screws 209.

The end partition 206 in each module 150*a*, 150*b*, 150*c* 150*d* is different from the remaining partitions 203, 204 and 205 only in that is has no rear flange, such as flange 203*b*, and, instead, as seen in FIG. 3, has a planer partition member 206*a* which is adapted to receive a sidewise opening socket 223, thereon. Furthermore, the rear edge portion of the top and bottom plates 200 and 201 are provided with opposed runners, such as runner 224 in FIG. 3 so as to receive a vertically disposed back pc board 225 which carries some of the IC circuitry for controlling the displays. When board 225 is slid into place on the runner such as runner 224, its edge connectors 226 contact the terminals of the socket 223.

When such a pc board 225 is provided, the module 150*a* or 150*c* is preferrably arranged for pivotal movement so that access can be had to the backside of that particular module 150*a* and 150*c*. In FIG. 3, it will be seen that diagonally opposed pairs of the modules 150*a* and 150*c* are pivotally mounted within the upper housing by means of bolts, such as bolt 230, which are aligned along a vertical axis, one bolt projecting through the top plate 95 and the other bolt projecting through the partition plate 77. Spacers 231 space the module 150*a* above the plate 77 and space it below the plate 95 so that it is freely pivotable as indicated in FIG. 3 by arrow 232. Thus, a person servicing the electronic systems will have access, as indicated by the arrow 233, into the interior and to the backside of module 150*d* or 150*b*. Second modules 150*b* and 150*d* are diagonally disposed within the upper compartment, as illustrated in FIG. 3. These modules 150*b* and 150*d* are different from the modules 150*a* and 150*c*, only in that they do not have pc boards such as pc board 225, and a socket, such as socket 223 in the rear portion of the module and hence do not need to be pivoted. Instead, a plurality of laterally spaced bolts 234 which project down through the plate 95 and into the module 150*b* or 150*d* suspend these modules from the upper plate 95, the bolts 234 being provided with spacers 235.

Referring specifically to the logic diagram contained in FIG. 10, the electrical service is provided from a source by wires 250 to the power supply assembly 81. This external power is 120 volts a.c. Out of the power supply assembly 81 via wires 252 is four d.c. voltages and also one a.c. potential which is used to feed the power fail detector 251. The power fail detector 251 is located on the main computer board 225. When detector 251 senses a power failure or low voltage, below 90 v.a.c. being supplied, then the computer or microprocessing unit 253 is signalled through an interrupt and that stops the operation and records all of the information or data, namely the price, the money, the volume and the totals into the non-volatile memory 280 for storage until the power returns. The price control board 254 is a separate board which is connected into the computer boards 253 via wires 255. That board 253 contains the thumb wheel switches (not shown) for setting the price manually when the system is in a stand alone mode. Board 253 alsc contains pump number switch for use when you are using a remote controller 262.

The interface board 60 receives and transmits a number of different peripherals to and from the main computer board 225. The pulser or pulse generator (transducer) 44 sends its signals into the interface board 60 and thence via wires 258 to the microprocessing unit 253. The totals switch 256 is connected via wires 260 to the interface board 60. The communications board 257 is connected, via wires 261, for use with the remote controller 262 and is connected to the interface board 60, via pins 281.

The pump handle switch 263 is connected via wires 267 into the interface board 60 and via wires 270 to the external power input 264. The read circuit of the external power input 264 sends a signal via wires 265 into the interface board 60 when the battery input 269 is connected via wires 266. The outputs from the interface board 60 go via wires 271 to turn on and off the valve V1 and via wires 272 to the self contained pump motor M1. Other circuits are used to interface this pump motor M1 with different types of remote controls (not shown) through the optional electromechanical relays 254*a* of the external power input 264. Current from battery input 269 is fed via wires 266 and the external power input 264 and wires 268 to the power supply assembly 81.

If there is no remote controller 262, when the pump handle switch 263 is turned on, there is provided a signal through the interface board 60 to the computer board 225. The computer board 225 then zeros via wires 273 the displays 214*a* and 214*c* of money and volume. It reads the thumb wheel switches from the price control board 259 to be sure the latest price is displayed on the display **214*b* and after that brief period of time, it activates the pump motor M1 and/or it activates the valves i.e., valve V1** which are necessary if you have a preset.

The microprocessing unit 253 then sends a signal through the interface board 60 to operate solid state relays 282. In both cases the solid state relays operate either the valves such as valve V1, or the self contained pump motor M1 through SSR switch 273. The pump then begins to feed liquid which causes operation of the pulser 44. The pulses from pulser 44 are sent to the interface board 60 and then into the computer board 225 where counting takes place. The volume delivered is displayed at display **214*c* as a direct function of that pulse count, unless the display is in liters. If it is in liters, the micro- processing unit 253 provides a gallon to liter conversion before it is displayed. Money display, at display 214*a*, always requires a calculation by the microprocessing unit 253** since the volume is multiplied by the price.

At the end of the sale when the pump handle is turned off, the "in use" signal via wire 267 disappears and this loss of signal locks out the circuitry until the next cycle. In the case of a stand alone liquid dispensing assembly, there would be no external communications with a remote controller 262. When a remote controller 262 is used, it is necessary that the remote controller 262 will authorize the microprocessing unit 253 before an "in use" signal from the handle switch 263 will have any effect. If so authorized, either by digital signals, coming through the communications board 257 from our remote controller 262, or authorized through the optional electro-mechanical relays **264*a* that generate an authorized signal, such a signal unlocks the microprocessing unit 253 so that when the handle switch 263 is turned on, an "in use" voltage appears in the microprocessing unit 253, again, and the liquid dispensing assembly is ready to go through a sale. At the end of the sale when the "in use" voltage disappears as the handle switch 263 is turned off, the liquid dispensing assembly is locked out, until it is reauthorized by either controller 262** or some other type of self service console.

Controller 262 can supply price change data in lieu of the thumb wheel switch of the price control board 254.

The totals are incremented through out the sale. Every time a fraction of a gallon or a penny is calculated by computer 253, it is added to the running totals. Those running totals are always up to date. But the running totals can only be displayed at the end of a sale, when the liquid dispensing assembly is out of use. Then by pressing the totals switch 256 a running or accumulated total will be displayed by display **214*c* or transmitted digitally to the remote controller 262. In other words the totals can be called up either by the local switch 256, on housing 90 in FIG. 3, which displays on all displays 214*c* or it can be called up by the remote controller 262 which causes it to be displayed on the remote control unit, (not shown). Also the totals may be printed out on an optional printer (not shown). The computer 253** functions, thus far described, are essentially conventional and, hence, no detailed circuitry is deemed necessary.

According to the present invention a non-volatile memory 280 is provided on the computer board 252. This memory 280 is employed only during periods of power failure caused by some external influence or caused by turning the power off at the end of the day. All of the information from the volatile memory, carried temporarily by computer 253, is stored in the non volatile memory 280 until the power returns or the equipment or the power is turned on the next day. Upon reactivation, the memory 280 is then erased and is ready to receive the next data, when the next power failure occurs. Running totals, the price and any volume and money information in the volatile memory of unit 253 is transfered to memory 280 only after the power has actually failed, or dropped, during a 0.2 of a second of storage or holdup time that is built into the power supply. It gives sufficient time to write this information in an orderly fashion into memory 280 and then shut down the computer 253 until the power returns to its normal range of operation.

For this purpose, the power supply 81 has two filter capacitors in parallel, rather than a single capacitor so as to double the normal size or storage capacity of the usual capacitor. Such capacitors have adequate storage to complete any shut down over a time span of 0.2 seconds, this time interval being adequate to orderly shut down and store all the information into the non volatile memory 280.

The power fail detector 251 has two different functions. One is to detect a complete failure of current and the other is to detect a low voltage, as the voltage drops to a minimum, in the vicinity of 90 volts or less. When either occur, a power fail interrupt signal is generated and fed to the microprocessing unit 253 which is programmed to then shut down. Thus, detector 251 functions as a low voltage detector which causes shut down of the dispensing assembly at about 90 volts. The dispensing assembly does not again begin to function until the voltage supply has risen to approximately 95 volts. At that point the operation is reset and started over again. The data, however, is recovered from the non volatile memory 280, and the dispenser is returned to normal operation.

In the event of multiple power failures, a time delay, programmed into the microprocessing unit 253, prevents the computer or unit 253 from trying to start up again until a certain time has elapsed. Otherwise with a series of rapid power failures you would never have enough time to get everything going again and the data would be lost.

The last sale is displayed at displays **214*a*, 214*b*, 214*c* until the handle switch 263 is turned on for the next sale. If the power fails or is turned off over night, when the dispensing assembly comes back on, or is turned on, the next morning, it still has the same last sale information displayed. That is all stored in the non volatile memory 280. As long as its power is on, there is a continuous display of price, money and volume of the last sale. Those, money and volume displays 214*a* and 214*c* are not zeroed until the start of the new sale, at which point the computer 253 goes through a step of displaying on the displays 214*a*, 214*b* and 214*c* all 8's and then a step of completely blanking out. Then the displays 214*a* and 214*c* go to zeros and display 214*b* goes back to the price. At that point the solid state relays 258*b* are activated to start the pumping operation. Thus, there are programmed a series of self checks that require a fraction of a second at the beginning of each sale to be certain that the displays are all working, properly. Only then is the pump motor M1 or valve V1** actually turned on to dispense the product.

The purpose of the battery input 269 is to enable an operator to recover a sale or totals in the event that the power goes off and stays off. Also, the battery input 269 is used to start up the computer 253 and light up the displays on one side of the dispenser, long enough to recover the previous sale should there be a customer who has been interupted by a power failure and desires to leave. The totals can also be read out in the event power is still off at the end of the shift and the station is going to be closed. The battery power, feeds voltage directly into the input of the power supply 81 which then operates in its normal fashion. The only thing different is that the displays are only energized on one side of the pump or assembly to conserve battery power. There are no provisions for actually running the pump motor M1 or valve V1 on battery power. It is merely a way of reading out the last information in the dispenser at the point at which the power failed. When this is employed, the computer 253 starts up, reads the information out of the non-volatile memory 280, displays it until one unplugs the battery pack at input 269, at which point there is a power fail signal, and storing the information into the non volatile memory 280 takes place.

The power pack 81 is a Boschert OL-25, modified to provide +5, +−15 and −30 volts, the pulser 44 is a Veeder Root model 767681-305. The display **214*a*, 214*b* and 214*c* are Futaba part no. 5LT51. The non volatile memory 280** is a 4096 bit, high speed, electrically alterable read only memory; namely an ER3400, produced by General Instrument.

It will be obvious to those skilled in the art that many variations may be made in the embodiment here chosen for the purpose of illustrating the present invention, without departing from the scope thereof as defined by the appended claims.

I claim:

1. A liquid dispensing assembly of the type having a housing, a hydraulic system within said housing for pumping liquid to dispense therefrom, an electrical display means for displaying visually the volume of liquid dispensed by said hydraulic system and displaying visually the computed price of the delivered liquid, an electronic computer means for receiving information from said hydraulic system and for progressively calculating the computed price of the liquid being delivered and for providing progress signals to said display means for generating the display of said calculated price of the delivered liquid, and circuits interconnecting said computer and said display means, the improvement comprising:

said housing having an electronic receiving compartment, a plurality of modules disposed within said electronic receiving compartment, each of said modules having an open fronts and opposed generally horizontally disposed runners in said modules, slideable removeable cards received by their edge portions by said runners, said cards having portions of said circuits thereon, the outer end of said cards terminating adjacent to the open front of its associated module, said display means including electronic visual displays respectively on the ends of said cards, said displays being disposed in the upright positions adjacent to the open fronts of said modules when said displays are received by said runners within said modules, said displays being electrically connected to said cards and window means for closing said electronic receiving compartment and through which said displays are viewed.

2. The liquid dispensing assembly defined in claim 1 wherein each of said modules includes a plurality of spaced upright walls carrying opposed pairs of said runners, for disposing said cards horizontally, said displays being generally perpendicular to said cards.

3. The liquid dispensing assembly defined in claim 1 wherein said housing is a tubular member and includes an intermediate compartment and a lower compartment, a partition plate disposed between said lower compartment and said intermediate compartment, said electronic computer means including a transducer mounted on said partition plate and disposed in said intermediate compartment, for converting the information from said hydraulic system into electric pulses, said computer means including an electronic computer which receives the electrical pulses and converts them into electronic signals which are fed through said circuits on said boards to said displays, said hydraulic system being disposed within said lower compartment, an output shaft, connected to said hydraulic system and means on said partition plate for connecting said output shaft to said transducer for providing the information from said hydraulic system.

4. The liquid dispensing assembly defined in claim 1 wherein each of said modules includes a top plate, a bottom plate disposed in opposed parallel horizontal relationship to the top plate, and a plurality of spaced upright partition walls disposed between said top plate and said bottom plate, said runners being disposed in opposed parallel pairs and being carried by said partition walls, said runners slideably supporting said cards, said displays being at the outer end portions of said cards and disposed generally vertically.

5. The liquid dispensing assembly defined in claim 1 wherein said housing includes a horizontally disposed top plate extending over said modules, and bolts extending down from said top plate for rotatably supporting certain of said modules, additional bolts extending down from said top plate for supporting other of said modules in fixed relationship to said top plate.

6. The liquid dispensing assembly defined in claim 1 wherein said housing includes a pair of parallel spaced horizontally disposed plates defining a dead air space above said electronic receiving compartment.

7. A liquid dispensing assembly of the type having a housing, a hydraulic system within said housing for pumping liquid to dispense therefrom, an electrical display means for displaying visually the volume of liquid dispensed by said hydraulic system and displaying visually the computed price of the delivered liquid, an electronic computer for progressively calculating the computed price of the liquid being delivered and for providing progress signals to said display means for generating the display of said calculated price of the delivered liquid, and circuits interconnecting said computer and said display means, the improvement comprising:

said housing having an electronic receiving compartment, a plurality of modules disposed within said electronic receiving compartment, each of said modules having opposed runners therein, slideable cards received by their edge portions by said runners, said cards having portions of said circuits thereon, said display means including electronic visual displays supported by and electrically connected to said cards at the outer end portions of said cards and window means for closing said electronic receiving compartment and through which said display is viewed, said plurality of modules including four modules, two disposed on each side within said electronic receiving compartment, certain of said modules being rotatable about vertical axes for permitting access to the rear of the modules.

8. A gasoline pump housing, having panels defining a lower compartment for receiving therein hydraulic components for dispensing gasoline from said housing and an upper compartment therein; the improvement comprising:

a plurality of modules disposed within said upper compartment, each of said modules having a top plate, a bottom plate spaced from and below said top plate, a plurality of spaced partition walls between said top plate and said bottom plate, opposed pairs of runners carried by said walls, electronic cards slideably carried by said runners, electrical visual displays respectively carried by the ends of said cards for movement therewith, each of said displays being electrically connected to its associated card, circuit means operative when said liquid is dispensed to actuate said displays for displaying the quantity of gasoline dispensed and the cost thereof, and means for supporting said modules in said upper compartment, flanges extending from said partition walls, and means removeably securing said displays to said flanges.

9. A gasoline pump housing, having panels defining a lower compartment for receiving therein hydraulic components for dispensing gasoline from said housing and an upper compartment therein; the improvement comprising:

a plurality of modules disposed within said upper compartment, each of said modules having a top plate, a bottom plate spaced from and below said top plate, a plurality of spaced partition walls between said top plate and said bottom plate, opposed pairs of runners carried by said walls, electronic cards slideably carried by said runners, electrical visual displays respectively carried by the ends of said cards for movement therewith, each of said displays being electrically connected to its associated card, circuit means operative when said liquid is dispensed to actuate said displays for displaying the quantity of gasoline dispensed and the cost thereof, and means for supporting said modules in said upper compartment, said means for supporting said modules including pivot means extending from said housing to one of said plates of one of said modules for permitting rotation of said modules about a vertical axis.

10. A gasoline pump housing, having panels defining a lower compartment for receiving therein hydraulic components for dispensing gasoline from said housing and an upper compartment therein; the improvement comprising:

a plurality of modules disposed within said upper compartment, each of said modules having a top plate, a bottom plate spaced from and below said top plate, a plurality of spaced partition walls between said top plate and said bottom plate, opposed pairs of runners carried by said walls, electronic cards slideably carried by said runners, electrical visual displays respectively carried by the ends of said cards for movement therewith, each of said displays being electrically connected to its associated card, circuit means operative when said liquid is dispensed to actuate said displays for displaying the quantity of gasoline dispensed and the cost thereof, and means for supporting said modules in said upper compartment, a generally horizontally disposed partition extending across the upper end portions of said panels for defining with said panels said lower compartment, flanges extending downwardly from the edges of said partition and over the outer portions of said panel, and corner brackets extending over the abutting edge portions of said flanges, outwardly of said partitions, said brackets each having bracket flanges angularly disposed with respect to each other and joined along a common edge, rivets passing through one bracket flange of each corner bracket for securing the same to a flange of said partition plate and a hook on the lower end of the other of said bracket flanges for slideably receiving the end portion of an adjacent partition flange therein.

11. A gasoline pump housing, having panels defining a lower compartment for receiving therein hydraulic components for dispensing gasoline from said housing and an upper compartment therein; the improvement comprising:

a plurality of modules disposed within said upper compartment, each of said modules having a top plate, a bottom plate spaced from and below said top plate, a plurality of spaced partition walls between said top plate and said bottom plate, opposed pairs of runners carried by said walls, electronic cards slideably carried by said runners, electrical visual displays respectively carried by the ends of said cards for movement therewith, each of said displays being electrically connected to its associated card, and circuit means operative when said liquid is dispensed to actuate said displays for displaying the quantity of gasoline dispensed and the cost thereof, and means for supporting said modules in said upper compartment, a pair of bezels disposed on opposite sides of said upper compartment, window panes in said bezels, face plates disposed in said bezels rearwardly of said window panes, each of said face plates having a recessed window aligned respectively with said displays, and light control films disposed over said windows.

12. The gasoline pump housing defined in claim 11 wherein said light control films are respectively disposed at an angle to the vertical of between about 5° and 20°.

13. A gasoline pump housing, having panels defining a lower compartment for receiving therein hydraulic components for dispensing gasoline from said housing and an upper compartment therein; the improvement comprising:

a plurality of modules disposed within said upper compartment, each of said modules having a top plate, a bottom plate spaced from and below said top plate, a plurality of spaced partition walls between said top plate and said bottom plate, opposed pairs of runners carried by said walls, electronic cards slideably carried by said runners, electrical visual displays respectively carried by the ends of said cards for movement therewith, each of said displays being electrically connected to its associated card, and circuit means operative when said liquid is dispensed to actuate said displays for displaying the quantity of gasoline dispensed and the cost thereof, and means for supporting said modules in said upper compartment.

14. The gasoline pump housing defined in claim 13, including a pair of spaced, horizontally disposed, parallel, upper and lower partition plates, the upper partition plate defining the lower portion of said upper compartment and the lower partition plate defining the upper portion of said lower compartment, and a tubular member disposed between said partition plates for defining an intermediate compartment.

15. The gasoline pump housing defined in claim 13 including a pair of spaced opposed parallel, horizontal, top housing plates forming the top portion of said housing, said top housing plates defining a dead air space therebetween, the lower of said top housing plates defining the upper portion of said upper compartment.

* * * * *